US005377415A

United States Patent [19]

Gibson

[11] Patent Number: 5,377,415

[45] Date of Patent: Jan. 3, 1995

[54] SHEET MATERIAL PUNCH

[76] Inventor: John Gibson, 12 Overlook Ave., Troy, N.Y. 12180

[21] Appl. No.: 165,332

[22] Filed: Dec. 10, 1993

[51] Int. Cl.[6] ..... B26F 1/02

[52] U.S. Cl. ..... 30/363; 30/358

[58] Field of Search ..... 30/363, 364, 368, 251, 30/358; 83/618, 633

[56] References Cited

U.S. PATENT DOCUMENTS

| | | | |
|---|---|---|---|
| 732,850 | 7/1903 | Hayden | 30/363 |
| 750,024 | 1/1904 | Etnyre et al. | 30/363 |
| 2,463,213 | 1/1949 | Stewart | 30/251 X |
| 3,505,714 | 4/1970 | Boileau | 29/21.1 |
| 4,033,037 | 7/1977 | Cooley | 30/36.3 |
| 4,525,929 | 7/1985 | Brophy, Sr. et al. | 30/251 X |
| 4,640,117 | 2/1987 | Anderson et al. | 30/363 X |
| 4,707,924 | 11/1987 | Burney | 30/363 |
| 4,729,170 | 3/1988 | Hartmeister | 30/363 |
| 4,753,010 | 6/1988 | Franovich | 30/124 |
| 4,768,693 | 9/1988 | Tomaszewski | 30/363 X |
| 4,987,683 | 1/1991 | Brych | 30/363 |

*Primary Examiner*—Rinaldi I. Rada

*Attorney, Agent, or Firm*—Schmeiser, Morelle & Watts

[57] ABSTRACT

An improved sheet metal punch including a second class lever system compounded with a hybrid first-third class lever system. A nutcracker-like tool employs two lever arms that are linked at the ends thereof by a fulcrum link and opposing fulcrum points, one on each of the lever arms, to actuate a hybrid first-third class lever system to drive a floating punch into a guide-stripper plate and die matrix assembly that are rigidly fixed to one of the levers. The punch assembly consists in a plate having a plurality of easily removable/replacable cylindrical tools projecting therefrom and which are used in combination with the die matrix to perforate sheet materials such as sheet metal, fiberglass and other relatively thin, planar substances.

12 Claims, 2 Drawing Sheets

FIG. 1
PRIOR ART
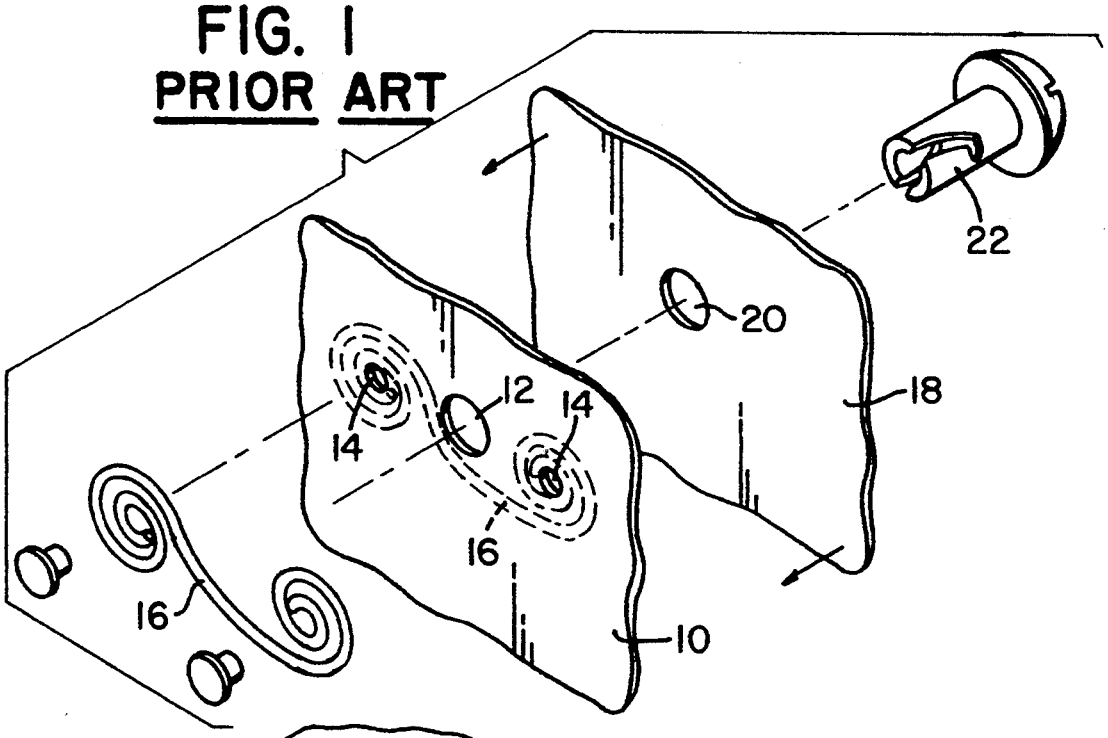
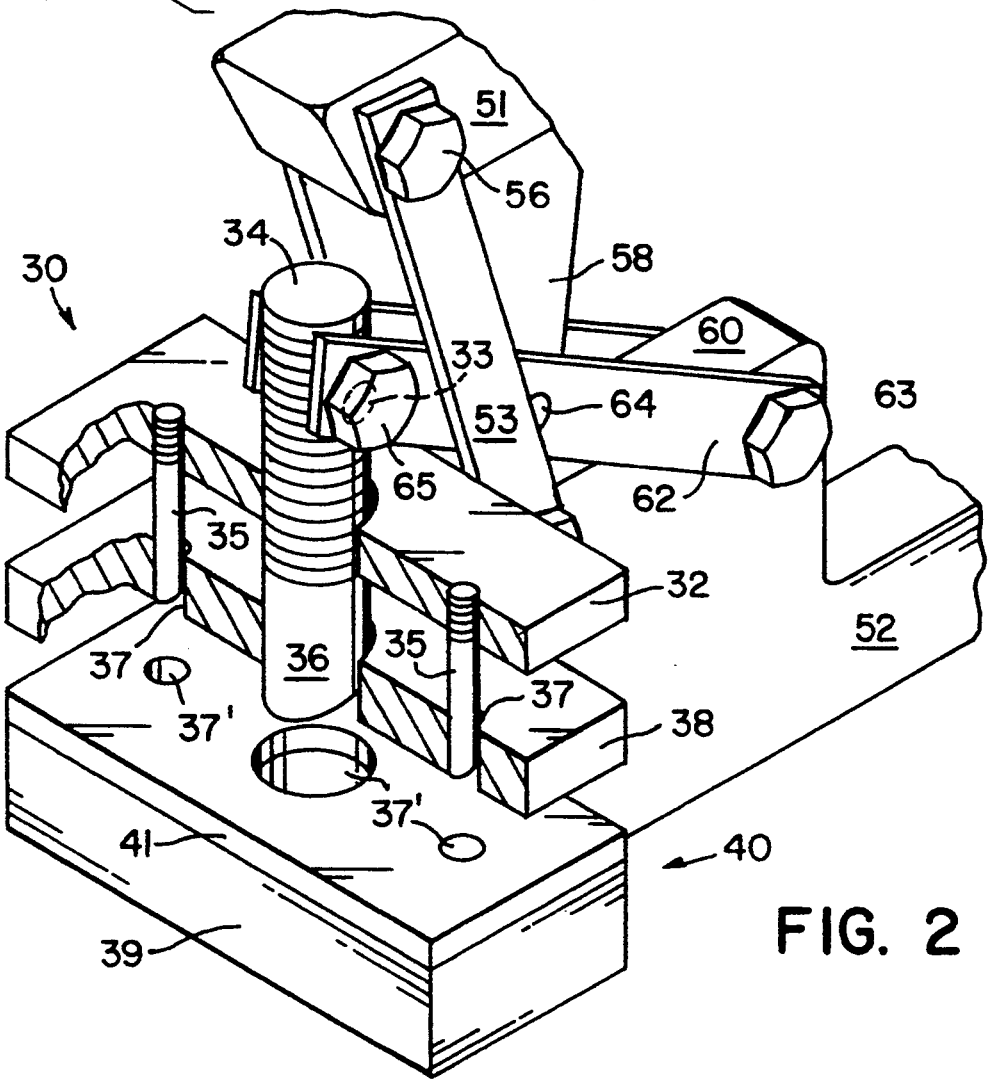
FIG. 2

SHEET MATERIAL PUNCH

BACKGROUND OF THE INVENTION

1. Field of the Invention

This invention relates, generally, to punches which are used to perforate sheet goods and, in particular, to hand held punch and die tools that are used to perforate the margins of sheet metal, fiber glass, plastic strips and heavy fabric or cardboard.

2. Discussion of the Relevant Art

In the industry with which I am involved, sheet metal repair and fabrication, a need has developed for a hand held tool that can be used to easily perforate the margins of sheet metal, disposing therein a series of holes having differing sizes. The particular need which I have sought to satisfy (in use of the instant invention) is to place, in the margin of sheet metal or similar goods, a set of three holes in central alignment. The purpose of these holes is to provide a receiving port at the center of the set for a DZUS (TM) type sheet metal fastener stud (on fitting), while the adjacent two holes are used to receive pop rivets, or similar apparatus, for the purposes of placing over and behind the central hole a sheet metal fastener wire bracket which serves to receive and capture a portion of the sheet metal fastener bolt.

In the course of business, it is necessary to replace portions of an automobile body with panels, aluminum sheets, that are cut from 4 ft.×8 ft. sheet metal stock. The panels are replacements and access panels for race cars, stock cars, go carts and the like. Sheet metal already on the car is referred to hereinafter as base or foundation (metal). During replacement of a panel on one of the subject vehicles, it is the custom to place the (replacement) sheet over a port in, or damaged area, of base metal so that substantial portions of base sheet and replacement marginally overlap. The replacement sheet has been prepared with holes through which the DZUS shank can pass, but the head cannot. The foraminous replacement sheet margin is placed over the base sheet margin and scribe or bench marks are placed at the center of the holes onto the base margin. Then, a template is used to drill holes for the DZUS shank and two straddling holes for the pop rivets, by which a DZUS retaining spring is attached. The drilling is tedious and can be readily avoided by use of a punching tool.

In U.S. Pat. No. 4,033,037, a method and a means for punching sheet goods are disclosed. A device for punching a plurality of holes adjacent the edge of one or more sheet members is shown that comprises a pair of elongate jaw members pivotally joined intermediate their length in "scissors-like" fashion. Here, two first class levers are disclosed sharing a common pivot-fulcrum so that, upon squeezing the handles thereof together, the jaws are caused to close, resulting in a typical punch-die machination. A punch is carried on one end of one jaw member and an aligner is positioned in side by side relationship to the punch, in a fixed, spaced relationship therefrom. The die matrix is carried by the other jaw member to receive the punch tool. Thus, only two tools are apparent in the '030 punching device, and one is used solely for the purposes of aligning the other. Intermediate the punch and the die matrix, is a stripper device consisting mainly of a thin, perforated tab that is used to restrain the sheet material as the jaws are opened and the alignment and punch tool are withdrawn from the die matrix. The '037 device fails to meet my immediate needs in that the alignment tool is superfluous and the opposed first class lever of the tool is insufficient for applying the kind of punching force that I require in my trade. A locking hole punch is disclosed in U.S. Pat. No. 4,707,924, that comprises an arm member having a head at the end of an outwardly curved portion and a first handle extending from that curved portion. A first lever member formed in a generally mating, outwardly curved configuration is pivotally connected to the arm at the top of the arm handle at a first pivot. A generally straight second lever, which acts as a second handle spaced from the arm handle, is pivotally connected to the first lever member at a second pivot with the first pivot. A toggle member is connected to the second lever at a third pivot and to the arm handle at a fourth pivot. When the arm and second handles are pressed together, the toggle member is driven so that the second, third and fourth pivots are moved into a straightline alignment and the punch, which includes a punching pin, is driven into a working position with a head. The toggle member can be further driven into a locked mode, which is releasable by operation of a toggle release device. The force application system of the '924 device is essentially a first class lever system. When this lever system is operated, the toggle member moves forward and toward the stationary arm of the tool allowing the first class lever system to close the pin-carrying jaw and, by an over-center motion lock or clamp to the arm member. The disadvantage of this form of mechanism, for my purposes, is that the patentee was more concerned with locking the punch member after the driving action, thus, there was no immediate requirement for a forceful punching action. The use of the first class lever system would be ideal in force transmission but for the fact that its application point (of rotation of the punching jaw) is too close to the common fulcrum that is used for pivotation of the jaws. Such a location negates the value gained in force multiplication through use of the first class lever system by compounding it with the third class lever system of the jaws. In most applications where one seeks mechanical advantage, the third class lever system simply does not have the effect of the first or second class lever systems. Further, once over center, the locking mechanism of the '924 tool would be highly disadvantageous since it is the premise in my form of work that the faster the holes may be punched, with the least amount of action, the better for the fabricator and the customer. A metal clipping tool disclosed in U.S. Pat. No. 3,505,714, is composed of a pair of lever arms, a fulcrum pin connecting the pair of lever arms together near one end, each of the pair of arms having an outwardly diverging crank at its connected end, a pair of jaws hingedly connected together, a pivot pin connecting each of the pair of jaws to a crank, the pair of jaws having free ends and opposing inner edges, a material clipping number carried by the free end of each of the pair of jaws to project inwardly of the opposing inner edge of the jaw, one of the material clipping members being a punch and the other of the members being an anvil, having a recess to receive the punch, and the punch and anvil being shaped to provide cooperating means that are adapted to form a substantially rectangular puncture in contacting structural members. In this tool, the lever arms are fulcrumed for first class leverage. The '714 tool has a distinct mechanical advantage over the tools of '037 and '924; but, the advantage of compounding first class levers is offset by the fact that the jaws used to carry the punch and die matrix of this tool are placed on very short levers and, therefore, no great mechanical advantage is gained. Further, when the tool handles are spread apart, the jaws actually extend forward of the common fulcrum and present a problem when one attempts to manipulate them into an alignment for rapid punching. Another disadvantage of the '714 tool is that no means are provided to restrain the punched metal as the punch is withdrawn; that is, there are no stripper means provided with the device.

Finally, U.S. Pat. No. 4,753,010 discloses, as an alternate embodiment, a tool consisting, essentially, of a bifurcated lower lever arm holding a guide and retainer means in the upper branch thereof for a sliding, vertical tool, which is brought into contact with an anvil on the lower branch of the bifurcated arm. The driving force for the sliding tool is a lever, working on the second class lever principle, that is fulcrumed or pivotally hinged to the extended upper branch of the bifurcated arm. As in the previously discussed art, the '010 tool remains deficient for my purposes. The patentee does not teach how the apparent arcuate motion of the upper arm would be translated to a purely linear motion in order to allow the cutting tool to remain in proper punching alignment. Another deficiency is the fact that the pivotal connection of the sliding tool with the upper arm lever is displaced too far rearward of the fulcrum to gain any significant mechanical advantage, being that this is a second class lever system. Finally, no stripper means are provided in order to withdraw the tool cleanly from a workpiece.

The deficiencies of all available cutting tools has caused me to develop my own special apparatus for perforating sheet metal with the particular three in-line holes that I require in my work. Up until now, the requisite perforations have been made in the receiving sheet metal foundation by use of scribing and physically drilling (generally by hand) the necessary holes.

SUMMARY OF THE INVENTION

I have overcome the disadvantages of the previously discussed relevant art by mating a second class lever system with what I term a hybrid first-third class lever system. The second class lever system, or the primary force application system, comprises a pair of lever arms, the ends of which are pivotally connected to opposite ends of a rigid link. This apparatus forms the traditional "nutcracker" type assembly. At the ends of the lever arms opposite the link, there are disposed handles for gripping the mechanism. Intermediate the handles and the link mechanism are fulcrums which project from each lever towards the other. One of the levers is bifurcated at an extreme end thereof. The bifurcated end of the lever contains a die matrix at one branch and, immediately thereover, on the other branch, a guide and stripper combination. A short rigid lever arm is pivotally connected to the fulcrum of the bifurcated arm, thence pivotally connected to the fulcrum of the non-bifurcated arm and terminated at a pivotal connection with a punch tool assembly just beyond the link which connects the two major levers of the invention. The tool assembly includes the mounting post for connection to the aforesaid rigid lever arm, a plate from which the post depends and a plurality of punches which are guided through the guide and stripper combination into the die matrix at the extreme and distal portion of the bifurcated arm.

In operation, sheet material is placed into the spacing of the bifurcated end previously described, and the handled levers are brought together. The second class lever action causes a force to be applied to the fulcrumed and pivotally mounted rigid lever arm causing it to be driven as both a first and third class lever, converting the angular motion of handle closure into a linear force that is applied to the post projection of the punch tool assembly.

BRIEF DESCRIPTION OF THE DRAWINGS

Of the Drawings:

FIG. 1 is an exploded isometric view of a sheet metal fastener of the prior art;

FIG. 2 is an exploded isometric illustration, in partial section, of the punch and die assembly of the instant invention.

DETAILED DESCRIPTION OF THE PREFERRED EMBODIMENT

Figure 3:
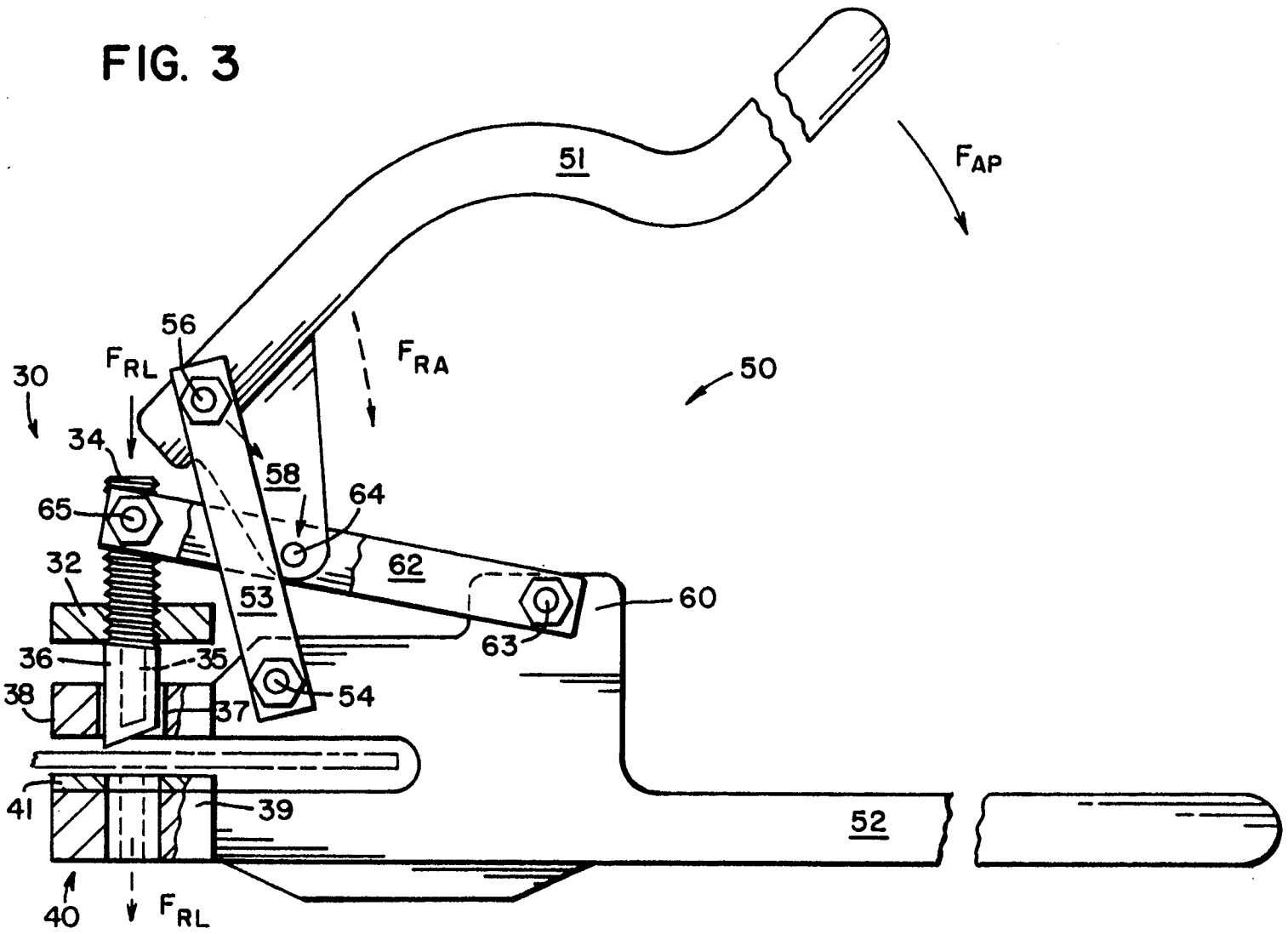
FIG. 3 is an elevation, in partial cross section, of the instant invention.

In order to better understand the utility of the instant invention, I would first digress in order to explain for the reader how my invention aids in the use of sheet metal fastener prior art. Referring more particularly to FIG. 1, there is shown a scheme for the attachment of one metal sheet to another. The first metal sheet 10 or base (foundation) structure is marginally fitted with the sheet metal fastener retainer spring 16. The retainer spring is attached to the base sheet 10 by pop rivets 14 which are seated in two small holes straddling a larger central hole 12. As seen from the illustration, the retainer spring is a very heavy device that is recessed slightly from the base sheet 10. A next sheet 18 is fastened to the base sheet 10 by passing a fitting 22 through a second hole 20 therein and thence through central hole 12 in order to capture the retainer spring 16. It is not in the interest of the instant inventor to modify the sheet metal fastener assembly, but rather to point out the application of this invention for the purposes of making the marginal holes 12, 14 in the original or foundation sheet 10 material. Perforating the foundation sheet with marginal holes 12 for fittings 22, each straddled by the holes 14 for pop rivets, is the operation that I seek to accomplish more rapidly and accurately with the instant invention.

FIG. 2 illustrates, in an exploded isometric drawing, the punch-die assembly that is used to obtain the three-holed pattern disclosed in FIG. 1. The punch-die assembly 30 consists of three main parts: the punch mount plate 32; the guide-release plate 38; and the die matrix 40. The guide-release plate 38 is superimposed over the die matrix 40 and is itself superposed by the punch mount plate 32. Referring to the punch mount plate 32, a mounting post 34 ascends orthogonally from the upper plate surface and is provided a pivotal bore 33 in which is placed the fifth pivot assembly 65. Depending downwardly and orthogonally from the punch mount plate 32 is a series of three threaded, easily replacable punch tools, the center punch tool 36, that is used to make the perforation for center hole 12, and punch tools 35 which straddle punch tool 36 and which are used to perforate the base material 10 for the provision of holes 14. By apparatus to be shown hereinafter, the punch mount plate 32 is suspended just over guide-release plate 38 and held in moveable registry therewith so that the tools 35, 36 pass freely into the guide-release plate 38. In fact, the guide-release plate, by its mounting, is held in fixed, set-apart registry with die matrix 40. Holes 37 are provided in the guide-release plate 38, as well as the die plate 41 and die base 39 which comprise the combination assembly that I term die matrix 40. It may readily be seen, therefore, that depressing the punch mount plate 32 downward so that the tools 35, 36 pass into the respective holes 37 will cause the tools to the pass through the spacing between guide-release plate 38 and die matrix 40. Thus, any sheet material located between the guide-release plate and the die matrix will be encountered by the tools 35, 36 as they traverse the aforesaid spacing and pass into the holes 37' of the die matrix 40. Material placed between the guide-release plate and the die matrix will be perforated by the tools and, upon withdrawal of the tools, the guide-release plate 38 will act as a stripper and assure that the material will not be deformed as the punch tools 35, 36 are fully withdrawn therefrom. This motion is characteristically linear and the conversion of the initial force, essentially an angular force, to the linear dimension will be illustrated in the discussion of the following FIG. 3 drawing.

The use of levers to acquire greater mechanical advantage during work is old in the history of man. One of the most common and most favored form of leverage is found in the common nutcracker which consists of a pair of handles fulcrumed at the ends thereof by a double pivoting link. A reference to FIG. 3 discloses that such is the basic force generation mode of my invention. The reader will note that the invention 50 consists essentially in a base lever, termed base arm 52, held in pivotal registry with a force application arm, also termed arcuate lever 51, that are linked proximate the ends thereof by fulcrum link 53. The link 53 is attached to the base arm 52 at a first pivot 54 and to the force application arm 51 at a second pivot 56. Essentially, an angular force $F_{AP}$ is applied by bringing the force application arm 51 and the base arm 52 together in a clamping motion. Pivoting on fulcrum link 53, work is accomplished by the very short resultant force $F_{RL}$ that is located between the ends of arms 51 and 52 and the fulcrum link 53. This is a classic second class lever compounded with another second class lever.

Before moving further into the second lever system, which is used as a compound mechanism for effecting the linear force for perforating the workpiece, it is necessary to observe the positioning of the FIG. 2 apparatus in relationship to the FIG. 3 compound system 50. Base arm 52, also termed base lever, is a bifurcated lever in which the guide-release plate 38 of FIG. 2 is positioned at an upper prong, part or branch thereof and the die matrix 40 is positioned at a lower part or branch thereof. The second part of the compound system 50 is a hybrid first-third class lever system composed of a lever 62 that is pivotally mounted 63 at one of its ends to a part known as the tertiary fulcrum 60 and which is located on the base arm 52 facing the force application arm 51. The tertiary fulcrum 60 is also termed, alternatively, the second adjunct fulcrum. Depending from the force application arm 51, and facing the base arm 52, is a projection 58 termed the first adjunct fulcrum or the secondary fulcrum. The secondary fulcrum 58 is pivotally attached to lever 62 at pivot 64, termed the fourth pivot. One pivot remains to be described and that is located at the free end of lever 62. The fifth pivot 65 mechanizes the linkage between lever 62 and punch mount plate 32 post 34. The reader is cued to the fact that fulcrum link 53 is positioned between fourth pivot 64 and fifth pivot 65. When force application arm 51 and base arm 52 are brought together, a resulting force is applied both at third pivot 63, which is mounted on tertiary fulcrum 60, and fourth pivot 64, which is mounted on secondary fulcrum 58. Relative to the diagram illustrated, a force results upwardly on pivot 63 and downwardly, via a camming action, on fourth pivot 64. The resultant of these countermoving forces is a linear (resultant) force, $F_{RL}$, that is effected at fifth pivot 65, driving the punch mount plate 32 downwardly towards the guide-release plate 38 and die matrix 40. Those of ordinary skill will readily recognize that first adjunct fulcrum—secondary fulcrum 58 need not be pivotally attached to lever 62 in order to effect the translation of angular motion $F_{AP}$ into linear motion $F_{RL}$. However, in order to properly and quickly withdraw the punch tools from the now perforated material, it is necessary that, upon separating base arm 52 and force application arm 51, lever 62 be moved in the direction of force application arm 51. Thus, the pivotation pin located at fourth pivot 64 is as necessary as those located at first pivot 54, second pivot 56, third pivot 63 and fifth pivot 65. It is essential, to the workings of my invention, that second adjunct-tertiary fulcrum 60 be located between the ends of the base arm 52 and force application arm 51 and their common fulcrum, fulcrum link 53. Likewise, first adjunct-secondary fulcrum 58 should also be located on the same side of fulcrum link 53 as was the second adjunct-tertiary fulcrum 60. Using this positioning, the lever 62, with its dual fulcrum assembly, is utilized as a first and third class lever system by virtue of the resultant work being effected at a lever end opposite the force application end and at the lever end opposite the force application and fulcrum points. In this manner, I construct my compound second class-and-hybrid lever system for powering a sheet metal punch tool.

By employing a compound lever system, I am able to readily convert what is essentially an angular motion, the closing of two levers or handles, to an essentially linear motion which allows accurate and rapid perforation of the sheet material with which I work. The excellent mechanical advantage of a second class lever system is combined with the distance and force advantages of the hybrid first-third class lever system that is used to drive the punch mount plate without misalignment by movement of the tools or die matrix. Those of ordinary skill may readily discern other applications for my unique compound lever system and are hereby commended such consistent with the hereinafter appended claims.

I claim:

1. An improved sheet metal punch tool including an elongate base arm, an elongate and inflected force application arm pivotally connected to said base arm and a punch subassembly disposed proximate an end of at least one of said arms, said punch tool comprising:

the said base arm having a bifurcated end further comprising a lower matrix means , which includes a die base and die plate, and an upper guide plate in set-apart, fixed parallel-plane registry therewith , at least one dual-pivot fulcrum link pivotally connected to said base arm proximate said bifurcated end to form a first pivot, and pivotally connected to said force application arm proximate a first end thereof to form a second pivot, said fulcrum link defining a common, primary fulcrum for said base and said force application arms;

a secondary fulcrum disposed on said force application arm, facing said base arm, and further disposed proximate said second pivot between said second pivot and a second end of said force application arm;

a tertiary fulcrum disposed on said base arm, facing said force application arm, and further disposed between said primary fulcrum and the second end of said base arm;

an improved punch subassembly comprising a horizontally disposed mounting plate, two or more elongate cutting tools aligned and projecting orthogonally from a base of said mounting plate and a post which projects orthogonally from a top of said mounting plate, said tools oriented for movable disposition into said upper guide means and thence into said matrix means; and a straight lever containing at least three holes therealong and which is pivotally connected at each of said three holes to said tertiary fulcrum, said secondary fulcrum and said orthogonal post, respectively, whereby a force applied to said second end of said force application arm and towards said base arm is multiplied and transmitted to said secondary fulcrum and thence to said straight lever at a point between said orthogonal post and said tertiary fulcrum thereby effecting a force for driving said tools through said guide means towards and into said matrix means.

2. The punch tool of claim 1 wherein said matrix means further comprises an orificed die base and an orificed die plate affixed thereon.

3. The punch tool of claim 2 wherein said guide means is a fixed, cantilevered, orificed plate disposed over and registry with said matrix means and which functions doubly as a tool guide and a workpiece stripper.

4. The punch tool of claim 3 wherein said at least one dual-pivot fulcrum link is an elongate lever having a hole at each end for pivotation thereabout.

5. The punch tool of claim 4 wherein said improved punch subassembly comprises a mounting plate of size and shape similar to said guide means and from which depend three in-line, elongate punch tools comprising a central tool flanked by equidistant, smaller diameter tools.

6. The punch tool of claim 5 wherein said straight lever is pivotally connected at one end to said tertiary fulcrum on said base, at the other end to said orthogonal post, and therebetween to said secondary fulcrum on said force application arm.

7. A sheet material punch comprising:

an elongate, base lever having a bifurcated end, said base lever pivotally connected to a fulcrum link, said fulcrum link connected to a first end of an elongate, arcuate lever, each said lever thereby sharing said link as a common fulcrum;

a first adjunct fulcrum disposed on said arcuate lever proximate said fulcrum link and between said link and an unconnected end of said arcuate lever, said first adjunct fulcrum further projecting towards said base lever;

a second adjunct fulcrum disposed on said base lever between said fulcrum link and a base lever said second adjunct fulcrum facing said arcuate lever;

an elongate tool lever pivotally connected at one end to said second adjunct fulcrum, extending to and pivotally connected to said first adjunct fulcrum and thence past said fulcrum link to a point of pivotal connection with a punch tool projection; and a punch-die assembly comprising a matrix which includes a die and a die base, disposed horizontally on a first portion of said bifurcated end distal said fulcrum link, a guide plate disposed on a second portion of said bifurcated end proximate said fulcrum link and superimposed over and parallel to said matrix, and a punch comprising a tool plate with plural punching tools depending downwardly therefrom that are oriented toward said guide plate and said matrix and having a punch tool projection extending upwardly from said tool plate opposite said punching tools and pivotally connected to said tool lever so that movement of said tool lever moves said tool plate.

8. A punch for placing aligned holes in a margin of sheet material comprising:

a first and a second lever pivotally connected proximate a first end of each to opposite ends of an elongate link, each said first and said second levers having handling means at a second end of each, each said first and said second levers having a fulcrum disposed between said handling means and said elongate link, each said fulcrum in opposition to the other and defining a first fulcrum and a second fulcrum, respectively;

a bar disposed between said levers, said bar pivotally connected at one end thereof to said second fulcrum and, intermediate the other end of said bar, connected pivotally to said first fulcrum, whereby said first fulcrum when driven towards said bar exerts a restricted camming action thereon causing said bar to act as both a first class and a third class lever to develop a punch driving force; and a punch-die assembly disposed at an extreme of said first end of the second lever and pivotally connected to said other end of said bar, wherefrom said punch driving force is derived for operation of said punch.

9. The punch of claim 8 wherein said elongate link is an elongate, rigid element having holes at each end thereof, said element providing fulcrums for each of said levers.

10. The punch of claim 8 wherein said punch-die assembly comprises:

a tool subassembly; a guide-stripper; and a die matrix.

11. The punch of claim 10 wherein said tool subassembly comprises a plate from which at one face depends a plurality of elongate punch tools and from a second face extends a projection having means for connecting the projection to said bar.

12. The punch of claim 11 wherein said guide plate is in fixed registry with said die matrix so as to strip a workpiece from off said elongate punch tools as said tools are withdrawn from said die matrix.

* * * * *